US012122011B2

(12) United States Patent
Zieger

(10) Patent No.: US 12,122,011 B2
(45) Date of Patent: Oct. 22, 2024

(54) HAND-HELD POWER TOOL

(71) Applicant: Robert Bosch GmbH, Stuttgart (DE)

(72) Inventor: Jens Zieger, Altbach (DE)

(73) Assignee: Robert Bosch GmbH, Stuttgart (DE)

( * ) Notice: Subject to any disclaimer, the term of this patent is extended or adjusted under 35 U.S.C. 154(b) by 638 days.

(21) Appl. No.: 17/417,588

(22) PCT Filed: Dec. 19, 2019

(86) PCT No.: PCT/EP2019/086386

§ 371 (c)(1),
(2) Date: Jun. 23, 2021

(87) PCT Pub. No.: WO2020/136086

PCT Pub. Date: Jul. 2, 2020

(65) Prior Publication Data

US 2022/0055176 A1 Feb. 24, 2022

(30) Foreign Application Priority Data

Dec. 27, 2018 (DE) ..... 10 2018 251 718.5
Dec. 27, 2018 (DE) ..... 10 2018 251 730.4

(51) Int. Cl.
*B24B 23/02* (2006.01)
*B24B 7/18* (2006.01)
*B24B 23/04* (2006.01)

(52) U.S. Cl.
CPC ..... *B24B 23/02* (2013.01); *B24B 7/186* (2013.01); *B24B 23/04* (2013.01)

(58) Field of Classification Search
CPC ..... B24B 23/00; B24B 23/005; B24B 23/02; B24B 23/03; B24B 23/04; B24B 19/26;
(Continued)

(56) References Cited

U.S. PATENT DOCUMENTS 1,868,507 A * 7/1932 Roos ..... B24B 23/04 29/DIG. 81
2,759,305 A * 8/1956 Helbig ..... A47L 11/4069 D8/62

(Continued)

FOREIGN PATENT DOCUMENTS

CN 1776257 A 5/2006
CN 103909502 A 7/2014

(Continued)

OTHER PUBLICATIONS

International Search Report corresponding to PCT Application No. PCT/EP2019/086386, mailed May 8, 2020 (German and English language document) (5 pages).

*Primary Examiner* — Joel D Crandall
(74) *Attorney, Agent, or Firm* — Maginot, Moore & Beck LLP

(57) ABSTRACT

A hand-held power tool, in particular a grinder, for simultaneously driving a plurality of grinding plates includes a main housing, which accommodates at least one motor for driving the grinding plates. A handle housing forms a handle and protrudes substantially perpendicularly to the main housing, and in particular the handle housing accommodates a storage battery. The hand-held power tool includes a motor having a drive shaft, which defines a motor axis, a central wheel, which is driven by the motor and defines a central wheel axis, and a plurality of, in particular three, output shafts, which are driven by the central wheel and define respective output shaft axes. Each output shaft is provided for driving one grinding plate or at least one grinding plate receptacle, and the motor axis is arranged eccentrically to the central wheel axis between a front output shaft axis and the central wheel axis.

19 Claims, 14 Drawing Sheets

(58) Field of Classification Search
CPC ..... B24B 19/265; B24B 7/18; B24B 7/192; B24B 7/186
See application file for complete search history.

(56) References Cited

U.S. PATENT DOCUMENTS 3,775,800 A * 12/1973 Veneziani ..... A01D 34/84 15/28
4,168,560 A * 9/1979 Doyel ..... A46B 13/04 15/29
5,500,972 A * 3/1996 Foster ..... A47K 7/04 15/28
5,863,241 A * 1/1999 Rottschy ..... B24B 7/186 451/271
6,185,781 B1 * 2/2001 Miller ..... A47L 9/0433 15/387
2004/0082285 A1 * 4/2004 Bohler ..... B24B 41/0475 451/359
2004/0132392 A1 7/2004 Bohler
2006/0194528 A1 * 8/2006 Rawlins ..... B24B 23/03 451/353
2007/0077873 A1 * 4/2007 Vankouwenberg ... B24B 41/047 451/353
2007/0232207 A1 * 10/2007 Palushi ..... B24B 27/0076 451/350
2009/0074511 A1 * 3/2009 Anderson ..... B24B 55/00 404/118

FOREIGN PATENT DOCUMENTS

CN 108115621 A 6/2018
CN 108290265 A 7/2018
CN 108356656 A 8/2018
CN 108367426 A 8/2018
DE 19733463 A1 * 2/1998 ..... B24B 23/03
DE 199 00 404 A1 7/2000
EP 1 016 504 A2 7/2000
EP 1 466 698 A1 10/2004
EP 3 330 044 A1 6/2018

* cited by examiner

HAND-HELD POWER TOOL

This application is a 35 U.S.C. § 371 National Stage Application of PCT/EP2019/086386, filed on Dec. 19, 2019, which claims the benefit of priority to Serial No. DE 10 2018 251 730.4, filed on Dec. 27, 2018 in Germany, and to Serial No. DE 10 2018 251 718.5, filed on Dec. 27, 2018 in Germany, the disclosures of which are incorporated herein by reference in their entirety.

The present disclosure relates to a hand-held power tool, in particular a grinder, for simultaneously driving a plurality of grinding disks, preferably for simultaneously driving three, in particular tiltable, grinding disks, which can be driven in a rotating and/or oscillating and/or randomly circular manner.

BACKGROUND

Hand-held power tools of this type are known, for instance, from EP1466698.

SUMMARY

A hand-held power tool is proposed. Advantageous embodiments, variants and refinements of the disclosure can be derived from the following disclosure.

The disclosure is based on a hand-held power tool, in particular a grinder, for simultaneously driving a plurality of grinding disks, preferably for simultaneously driving three, in particular tiltable, grinding disks, which can be driven or are driven in a rotating and/or oscillating and/or randomly circular manner. The hand-held power tool has a motor having a drive shaft which defines a motor axis, a central wheel driven by this motor, in particular a spur wheel, which defines a central wheel axis, and a plurality of, in particular three, output shafts, which are driven by the central wheel and which respectively define an output shaft axis, wherein each output shaft is provided to drive, respectively, a grinding disk or at least, respectively, a grinding disk holder.

It is proposed that the motor axis is arranged eccentrically, in particular parallelly and eccentrically, to the central wheel axis. It is disposed between a frontal output shaft axis and the central wheel axis. It is proposed that the motor axis intersects a straight connecting line between an, in particular frontal, output shaft axis and the central wheel axis; thus it is disposed between the, in particular frontal, output shaft and the central wheel axis. As a result, weight is shifted onto the frontal or front grinding disk, with the result that a smoother running of the hand-held power tool during grinding can be obtained.

The central wheel axis and the drive and output shaft axis are preferably arranged substantially parallel to one another. The central wheel axis is preferably disposed in the center of a regular polygon, in particular a regular triangle, in the corners of which are disposed the, in particular three, output shaft axes.

It is further proposed that the motor or its motor axis, in relation to the central wheel axis, is disposed opposite a handle or handle housing, in particular a barrel handle, oriented transversely to the central wheel axis. The motor hence acts as a counterweight to the handle, in particular to the storage battery disposed in or on the handle. The three grinding disks, in particular, are thus subjected to a load which is as uniform or homogeneous as possible. A fatigue-free working, a smoother running and/or a better balanced hand-held power tool are provided. The user-friendliness can thus be enhanced.

Because the handle housing protrudes in particular in the form of a barrel handle from the main housing, it can be easily and/or comfortably gripped by a hand. The hand-held power tool can be easily guided, in particular into corners or under objects which limit the accessibility of workpieces which are to be machined. The visibility of the hand-held power tool or of the workpiece to be machined is improved, since the hand of the user is less in the field of vision onto the workpiece to be machined. The user friendliness is enhanced.

It is proposed that the handle or the handle housing is provided to accommodate a storage battery, in particular an exchangeable storage battery, preferably an exchangeable insertable storage battery. Because the storage battery is disposed at least substantially in the handle, the main housing can be of compact configuration. The accessibility for the loading and/or exchanging of the storage battery can be improved. The motor arranged eccentrically in relation to the central wheel axis, opposite the handle, constitutes a counterweight to the storage battery. As a result of the opposite arrangement of motor and storage battery, the hand-held power tool is better tared. The centers of gravity of motor and storage battery do not lie on one side of the center axis or of the hand-held power tool.

It is proposed that the handle or the handle housing protrudes from a main housing, which accommodates at least the motor, the central wheel and the drive and output shafts, at an angle between 45° and 135° in relation to the orientation of the central wheel axis. As a result of such an orientation, the handle can be comfortably gripped. The fingers can encompass the handle. The guidance of the hand-held power tool is facilitated, the visibility, in particular, of a front of the hand-held power tool is improved.

It is proposed that a longitudinal axis of the handle, or substantially a center axis of the handle, and the central wheel axis span one plane, wherein two output shafts are arranged in mirror symmetry to the plane. Two of the grinding disks or the grinding disk holder are thus also arranged substantially in mirror symmetry to the plane. The weight distribution and load distribution of the hand-held power tool are consequently ideal. The grinding result is as homogeneous as possible. The maneuverability is tared. The hand-held power tool sits comfortably in the hand. The rear output shaft axes are symmetrical to the center axis of the storage battery or of the handle. The center axis of battery, motor and frontal output shaft or frontal grinding disk lie on the plane or center plane of the hand-held power tool. The left and right sides of the hand-held power tool side are hence balanced out, with the result that the forces acting on the hand-arm system of the user during working are reduced.

It is proposed that the frontal output shaft comes to lie in the plane. In particular, the third output shaft comes to lie, in relation to the central wheel axis, opposite the handle. A front side of the apparatus is thereby defined in relation to the handle. The weight of the hand-held power tool is as far as possible tared.

It is proposed that the motor axis comes to lie in the plane. The motor and/or the motor axis is/are disposed substantially between the third output shaft and the central wheel axis, in particular in the plane.

It is proposed that the plane centrally intersects the storage battery and/or the motor. As far as possible, a mirror symmetry of the hand-held power tool between right and left side of the plane is enabled. As a result, as far as possible, there is no torque generated about the center axis of the handle, thereby helping to ensure the fatigue-free working and a comfortable handling of the hand-held power tool.

It is proposed that the center of gravity of the hand-held power tool, in relation to the central wheel axis, comes to lie opposite the motor axis or the motor, and/or between handle and central wheel axis. In particular, the center of gravity comes to lie in the plane. Also, as far as possible, there is no torque generated about the center axis of the handle, thereby helping to ensure the fatigue-free working and a comfortable handling of the hand-held power tool. In addition, the position of the storage battery is enabled by virtue of the fact that the hand-held power tool can also stand securely on the rim of the rear grinding disks and on the grip end. As a result, the grinding disks are in the air and, in the work breaks, can cool off better and be freed from dust. Two stable standing positions of the grinder can occasionally also be provided—firstly standing on all three grinding disks; secondly mounted on the rim of the two rear grinding disks, and also on the free end of the handle.

It is proposed that the hand-held power tool is provided for three-point mounting on two grinding disks facing toward the handle, and on the free end of the handle or the free end of the insertable storage battery.

The grinding disks can hence cool off rapidly. A checking of the state of the abrasive is easily possible. A monitoring of the state of that region of the hand-held power tool that is facing the workpiece to be machined is easily possible. A regripping of the hand-held power towel or of the handle is likewise easily possible by virtue of the good accessibility.

The disclosure is based on a hand-held power tool, in particular a grinder, for simultaneously driving a plurality of grinding disks, preferably for simultaneously driving three, in particular tiltable, grinding disks, which can be driven or are driven in a rotating and/or oscillating and/or randomly circular manner, comprising a main housing, which accommodates at least a motor for driving the grinding disks. It is proposed that a handle housing, which forms a handle, protrudes substantially transversely to the main housing, in particular protrudes in the style of a barrel handle from the main housing, in particular wherein the handle housing is provided to accommodate a storage battery, in particular an insertable storage battery. The main housing typically accommodates a motor having a drive shaft which defines a motor axis, a central wheel driven by this motor, in particular a spur wheel, which defines a central wheel axis, and a plurality of, in particular three, output shafts, which are driven by the central wheel and which respectively define an output shaft axis, wherein each output shaft is provided to drive, respectively, a grinding disk, or at least, respectively, a grinding disk holder. Typically, the central wheel axis and the drive and output shaft axes are preferably arranged substantially parallel to one another. The central wheel axis is preferably disposed in the center of a regular polygon, in particular a regular triangle, in the corners of which are arranged the, in particular three, drive shaft axes.

Because the handle housing protrudes in particular in the form of a barrel handle from the main housing, it can be easily and/or comfortably gripped by a hand. The hand-held power tool can be easily guided, in particular into corners or under objects which limit the accessibility of workpieces to be machined. The visibility of the hand-held power tool or of the workpiece to be machined is improved, since the hand of the user is not in the way. The user friendliness is enhanced.

Because the storage battery is disposed at least substantially in the handle and not in the main housing, the main housing can be of compact configuration. The accessibility for the loading and/or exchanging of the storage battery can be improved.

In addition, a status display for the state of the storage battery and/or of the hand-held power tool is disclosed herein, which status display is switched on or activated upon a change of position of the hand-held power tool, in particular upon a movement of the hand-held power tool at least about the center of gravity of the storage battery or of the hand-held power tool.

Moreover, in some embodiments, the status display is switched off or deactivated upon an activation of the hand-held power tool and/or after a preset or presettable time interval.

BRIEF DESCRIPTION OF THE DRAWINGS

The disclosure is explained in greater detail below on the basis of illustrative embodiments represented in the drawings, wherein.

DETAILED DESCRIPTION

Figure 1:
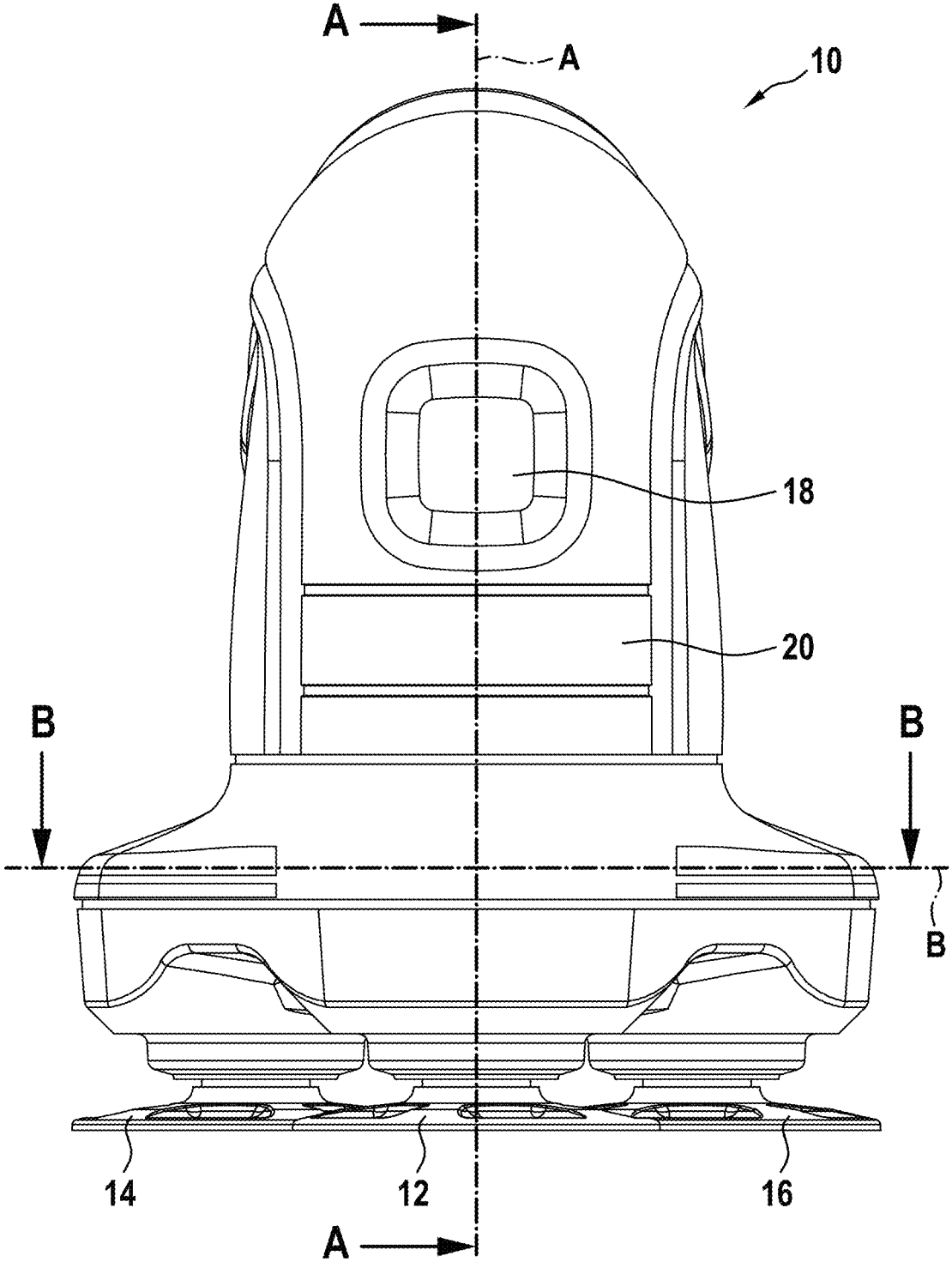
FIG. 1 shows the hand-held power tool in a front view.

FIG. 1 shows the hand-held power tool in the form of a grinder 10 in a front view. The grinder 10 is provided to simultaneously drive three grinding disks 12, 14, 16: a frontal grinding disk 12 and two rear grinding disks 14, 16. By virtue of a universal-shaft-type or cardanic suspension (cf. FIG. 2) of the grinding disks 12, 14, 16, these are pivotably or tiltably mounted. They are rotatingly driven and are well suited to grinding also curved surfaces. Via an actuating switch 18, the grinder can be activated. An identification element 20 advantageously assigns this apparatus to a product series or a manufacturer.

Figure 2:
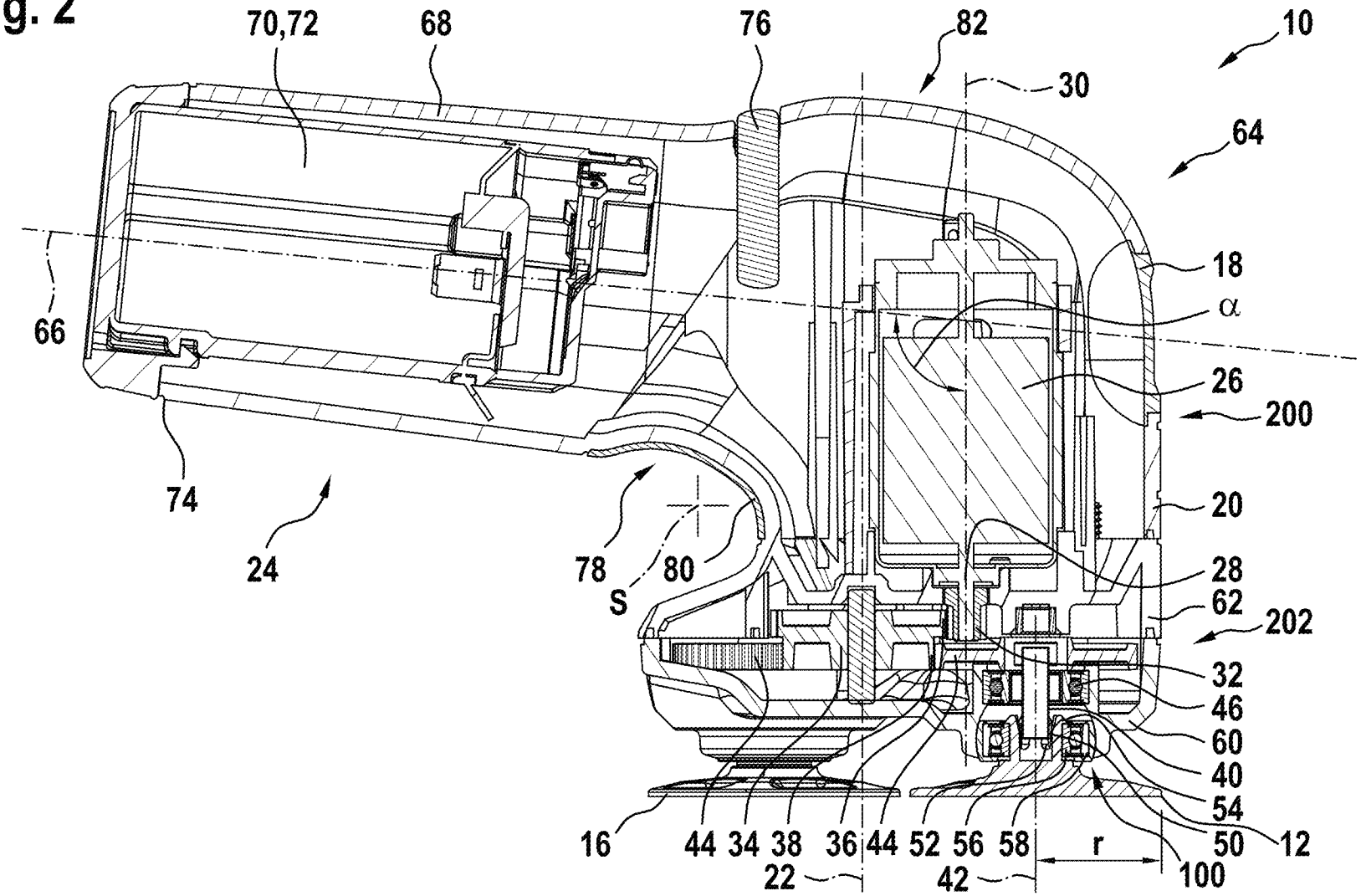
FIG. 2 shows the hand-held power tool in a sectional representation A-A.

FIG. 2 shows the hand-held power tool in the form of the grinder 10 in a sectional representation A-A through the plane A (cf. FIG. 1). The frontal grinding disk 12 is disposed in front of a central wheel axis 22. It is arranged, in relation to a central wheel axis 22, opposite a handle 24. The two rear grinding disks 14, 16, of which, in this representation, only the grinding disk 16 can be seen, are disposed on that side of the central wheel axis 22 that is facing toward the handle 24. The three grinding disks 12, 14, 16 are configured such that they are structurally identical and exchangeable. A motor 26 has a drive shaft 28. The motor 26 or its drive shaft 28 defines a motor shaft axis 30. Via a pinion 32, the motor 26 drives a central wheel 34, which defines the central wheel axis 22. The central wheel 34 is driven, via a spur wheel 36, by the pinion 32. The central wheel 34 has a toothing 38, with which it drives three output shafts 40, whereof, in the section A-A, only the front one can be seen. These output shafts 40 in turn define output shaft axes 42. Each output shaft 40 is in turn provided to drive, at least indirectly, respectively a grinding disk 12, 14, 16. The central wheel 34 drives, via the toothing 38, three spur wheels 44, (whereof the spur wheel 44 driving the grinding disk 12 can be seen in section and the spur wheel 44 driving the grinding disk 16 can be seen in side view). The frontal spur wheel 44 drives the output shaft 40; the drive mechanism can analogously be transferred to all spur wheels 44 driving the grinding disks 12, 14, 16. The output shaft 40 is here mounted, by way of example via at least one deep-groove ball bearing 46, in a housing part 60. A slide bearing 48 supports the output shaft 40 additionally in a further housing part 62. The two housing parts 60, 62 form an output shaft housing 202. The output shaft housing 202 forms, together with a motor housing 200 which substantially encloses the motor 26, a main housing 64, which accommodates at least the motor 26, the central wheel 34 and the drive and output shafts 28, 40. The output shaft 40 engages, via a driver 50, in coupling means 52 of the grinding disk 12. The grinding disk 12 can be clipped by means of latching hooks 54 into a grinding disk holder 56. The grinding disk holder 56 is disposed in the region of an opening 100 of the housing part 60. Through the opening 100, the coupling means 52 of the grinding disk 12, or the latching hooks 54, can be plugged into the grinding disk holder 56 or onto the driver 50. The grinding disk holder 56 enables, in addition to the low-friction rotational mounting of the grinding disk 12 (here with deep-groove ball bearing 58), also a pivoting (here by virtue of a spherical slide bearing in a spherical holder of the housing part 60). The universal-shaft-type drive enables a tilting of the grinding disk 12 in relation to the housing part 60 or relative to the grinder 10. The central wheel 34 drives the grinding disks 12, 14, 16 in a forcibly rotating manner. In principle, an oscillating driving or a randomly circular driving of the grinding disks 12 is also possible however, for instance by output shafts 40 which are eccentrically accommodated in the spur wheel 44 and which drive the grinding disks 12, 14, 16 in a forcibly coupled or randomly rotating manner, or by an eccentric cam which, by restricting degrees of freedom of the grinding disk and/or of the output shaft, generates an oscillation motion—or the like (not represented in detail here).

The drive shaft 28 or the motor shaft axis 30 is arranged eccentrically to the central wheel 34 or to the central wheel axis 22. It is disposed between the frontal output shaft axis 42 and the central wheel axis 22. Both axes 22, 30 are intersected by the plane A or come to lie in this. The motor 26 is shifted in the direction of the frontal grinding disk 12 or its grinding disk holder 56. The motor 26 or its motor shaft axis 30 is disposed, in relation to the central wheel axis 22, opposite the handle 24. The handle 24 is likewise centrally intersected by the plane A, ideally divided in mirror symmetry. The motor shaft axis 30, the central wheel axis 22 and the output shaft axes 42 are oriented parallel to one another. Transversely to the central wheel axis 22 is arranged the handle axis 66 or the center axis 86 or longitudinal axis 84 of the, in particular, barrel-shaped handle 24. The angle $\alpha$ measures around 45-135°, in the present illustrative embodiment around 100°. The handle 24 protrudes from the main housing 64. The plane 4 or the sectional plane A-A is to a certain extent also spanned by the handle axis 66 and the central wheel axis 22. The handle 24 is barrel-shaped, substantially round or oval or the like. It is formed by the handle housing 68, which can be configured, at least in part, in one piece with the main housing 64. The handle 24 is provided to accommodate a storage battery 70. The latter can be permanently integrated or can be configured as an exchangeable storage battery 70. In the present illustrative embodiment, it is configured as an exchangeable storage battery 72. It is inserted into the free end 74 of the handle 24 and is detachably connected to the handle housing 68 via latching elements (not represented here). Optionally, a rotation speed of the motor 26 is able to be set via an adjusting wheel 76. In addition, the handle 24 and the main housing 64 are ergonomically shaped. The concave indentation 78 in the transition from the handle 24 to the main housing 64 serves for the intuitive gripping with the index finger. This region can also be covered with a soft grip 80. Naturally, other regions of the hand-held power tool can also be covered with especially haptic and/or tactile materials. However, also the top side 82 of the main housing 64 is provided to support a hand, in particular the palm of the hand, whether it be to guide the hand-held power tool with two hands or with one hand, solely by gripping of the main housing 64.

Figure 3:
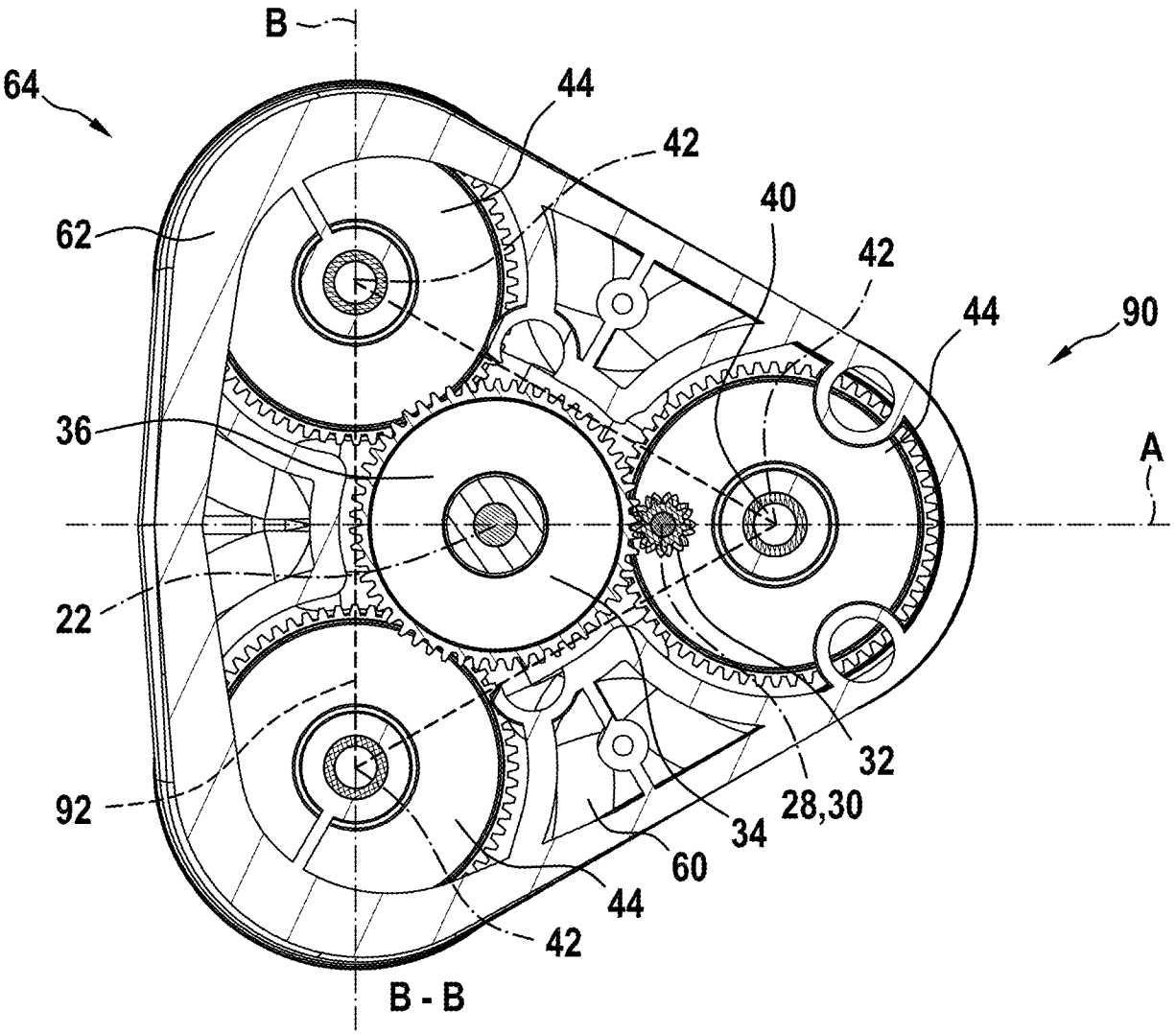
FIG. 3 shows the hand-held power tool in a sectional representation B-B.

FIG. 3 shows the grinder from FIG. 1 in a sectional representation B-B in the plane (B). The drive shaft 28 drives, via the pinion 32, the central wheel 34. The motor shaft axis 30, and hence the motor 26, is arranged eccentrically to the central wheel 34, to be precise—displaced in the direction of a front side 90 of the grinder 10. The central wheel axis 22, the motor shaft axis 30 and the output shaft axis 42 of the frontal output shaft come to lie in the plane A. Orthogonally to this plane A, the plane B is spanned. In the plane B come to lie the output shafts 40 arranged in mirror symmetry to the plane A. The central wheel axis 22 is disposed in the center of a regular triangle 92, in the corners of which are arranged the three drive shaft axes 42. Via the central wheel 34, the three spur wheels 44 are rotatingly driven. The spur wheels 44 in turn drive the output shafts 40, which, at least indirectly, drive the grinding disks 12, 14, 16 or grinding disk holders 56 (cf. FIG. 2).

Parts of the main housing 64 or of the housing part 60 and further housing part 62, which hold the drive and output elements of the grinder 10 in position, are also represented.

Figure 4:
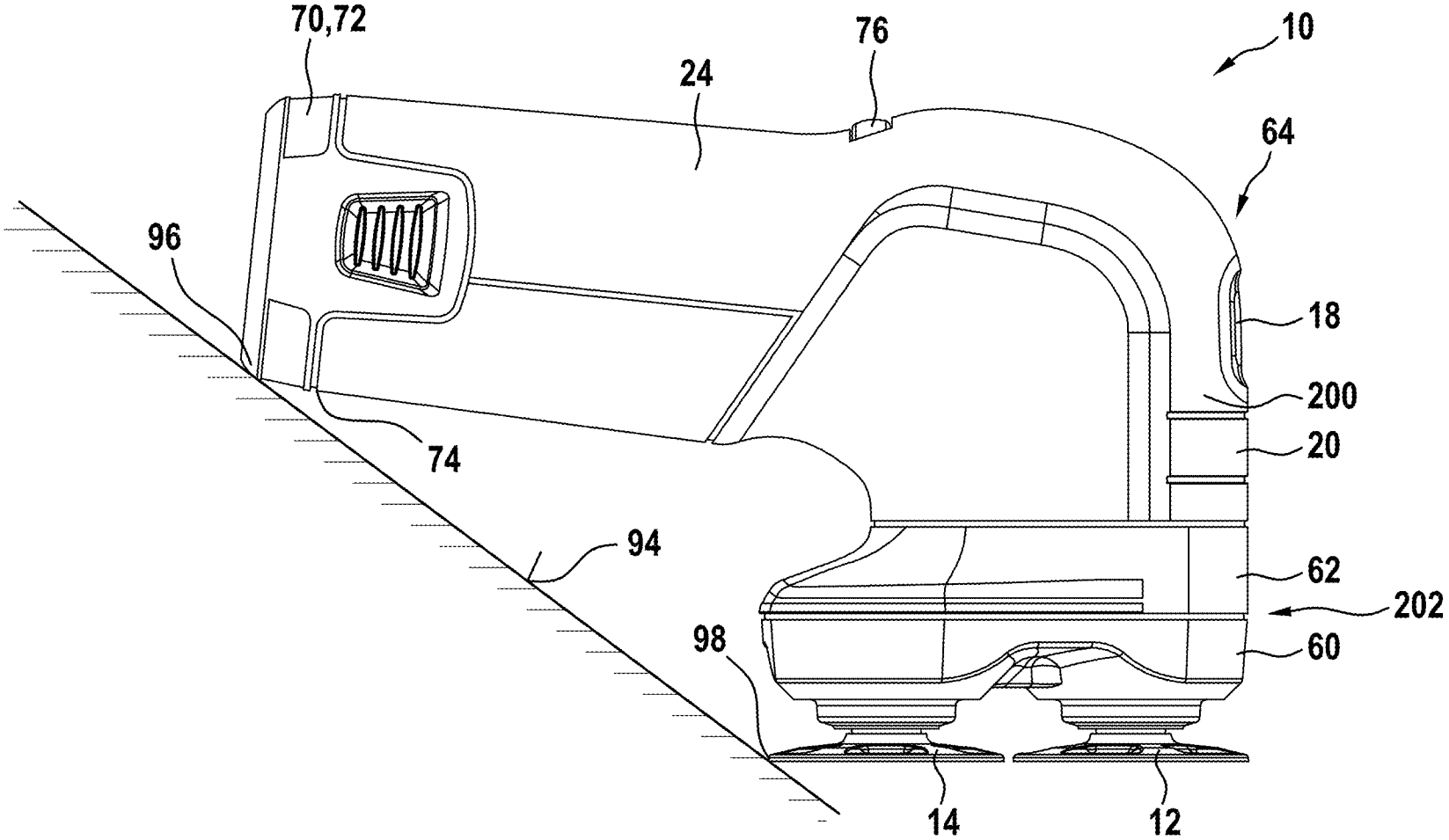
FIG. 4 shows the hand-held power tool in a side view in a rest position.

FIG. 4 shows the grinder 10 in a rest position on a support surface 94, for instance a workpiece to be machined. The grinder 10 rests on three points, namely on a free end 96 of the insertable storage battery 70 (alternatively it could also rest on the free end 74 of the handle 24, in particular in the case of a storage battery 70 which is fixedly built into the handle 24) and on the rim 98 of the rear grinding disks 14, 16, in particular that rim 98 of the grinding disks 14, 16 that is facing toward the free end 74, 96 of the handle 24 or of the insertable storage battery 72 (wherein only the grinding disk 14 is visible, since it conceals the grinding disk 16). In principle, for same component parts from the different figures, the same reference symbols are allocated, yet they are not necessarily explained anew in respect of each figure.

Figure 5:
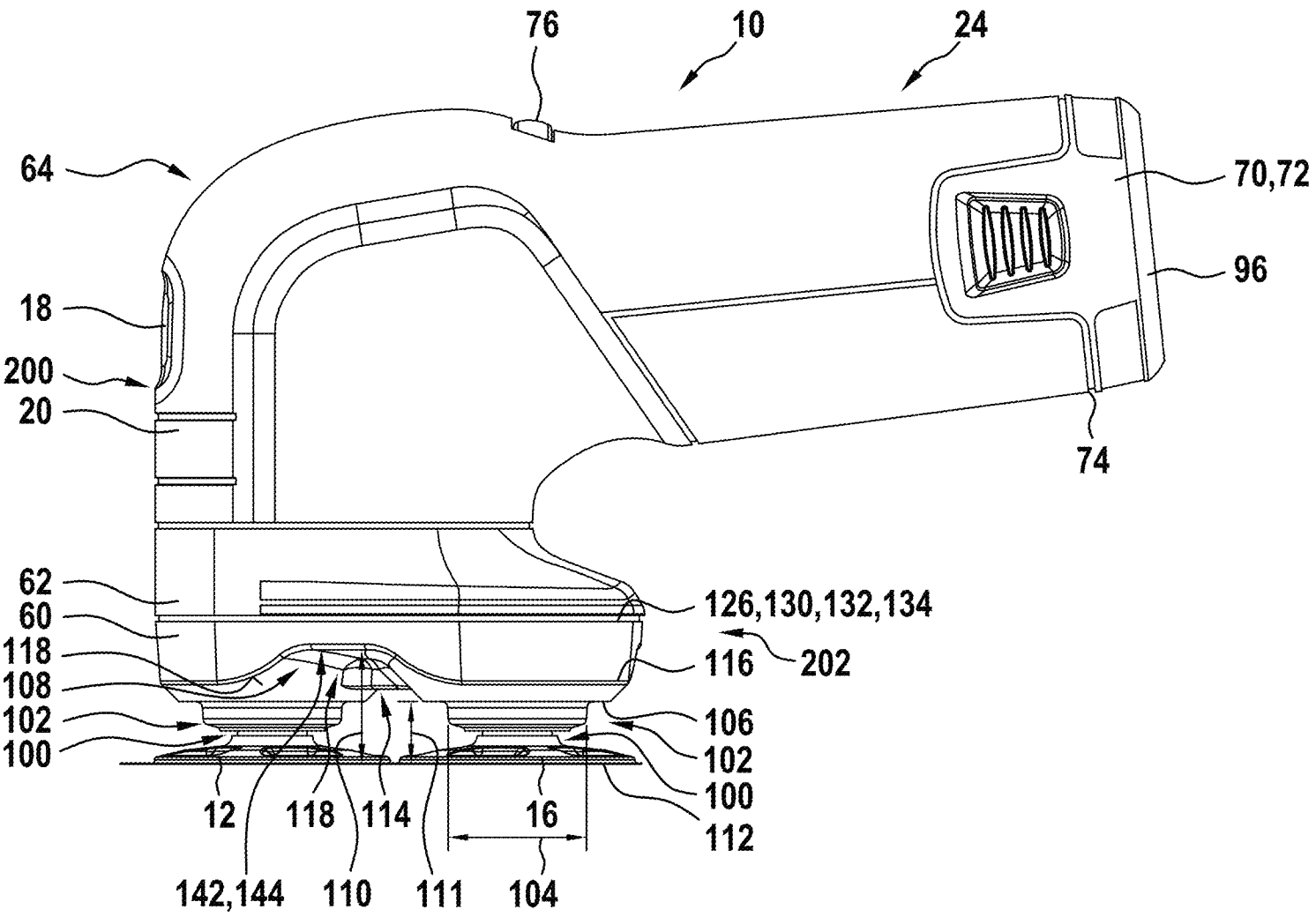
FIG. 5 shows the hand-held power tool in a side view.

FIG. 5 shows the hand-held power tool or a grinder 10 in a side view. The housing part 60 has three grinding disk receiving regions 102, whereof in FIG. 5 only two can be seen. As the grinding disk receiving region 102 should be defined that region of the housing part 60 that supports the grinding disk holder 56 and its component parts, such as, for instance bearings. By way of example, this is the region having the enveloping circle diameter 104 around the grinding disk receiving regions 102. In the present illustrative embodiment, this region is offset in the direction of the grinding plane 112 by a, in particular, directly surrounding housing region 106 of the housing part 60 (for the accommodation of the bearings, better accessibility and/or in order to improve the freedom of movement of the grinding disks 12, 14, 16, for example during tilting/pivoting). In other words, the surrounding housing region(s) 106 is/are set back from the grinding disk receiving region(s) 102. This back-offset should not, however, be construed as a recess 108 within the meaning of the disclosure. The grinding disk receiving regions 102 respectively have openings 100, through which the removable grinding disks 12, 14, 16 can be connected to the grinder 10. In this way, the coupling means 52 and/or latching hooks 54 can be connected to the output shafts 40 and/or grinding disk holders 56 (cf. sectional representation, FIG. 2). Alternatively, also the grinding disk holders 56 or the output shafts 40 can project through the grinding disk receiving regions 102. Insofar as only output shafts 40 project through the housing part, whether because the reception of the grinding disks 12, 14, 16 takes place outside the housing part 60 of the hand-held power tool or because the grinding disks 12, 14, 16 are non-detachably connected to the output shafts 40, the grinding disk receiving region 102 can also be understood only as that region which constitutes the opening 100; or that region which supports the output shafts 40 in the housing part 60 of the hand-held power tool.

Between two adjacent grinding disk receiving regions 102 or the openings 100 (so to speak, in the interspace 122), the housing part 60 has an air guide channel 120. This is formed by a recess 108. In the region of the air guide channel 120 or the recess 108, the distance 110 between the housing part 60 and a grinding plane 112 is enlarged, in particular enlarged in relation to the distance 111 of the housing region 106 from the grinding plane 112. Accordingly, the recess 108 is set back from the housing region 106. The recess 108 has a concave shape 118. It tapers in the direction of the center of the housing part 60, or becomes narrower in the peripheral direction. Moreover, a size of the recess decreases in this direction. The housing part 60 is thus drawn-in or indented in the direction facing away from the grinding plane 112. Starting from a center region 114 of the housing part 60, in particular a center region 114 in the center between the grinding disks 12, 14, 16 or in the region of the central wheel axis 22 intersecting the housing part 60, the distance 110 between housing part 60 and grinding plane 112 increases along the air guide channel or recess 108, outward in the radial direction, thus in the direction of the rim 116 of the housing part 60. The recess 108 is thus, in the outer region of the housing part 60, larger than in a middle region. The recess 108 serves for better air guidance. The recess 108 forms at least a part of an air guide channel 120, in particular for the dust extraction.

Figure 6:
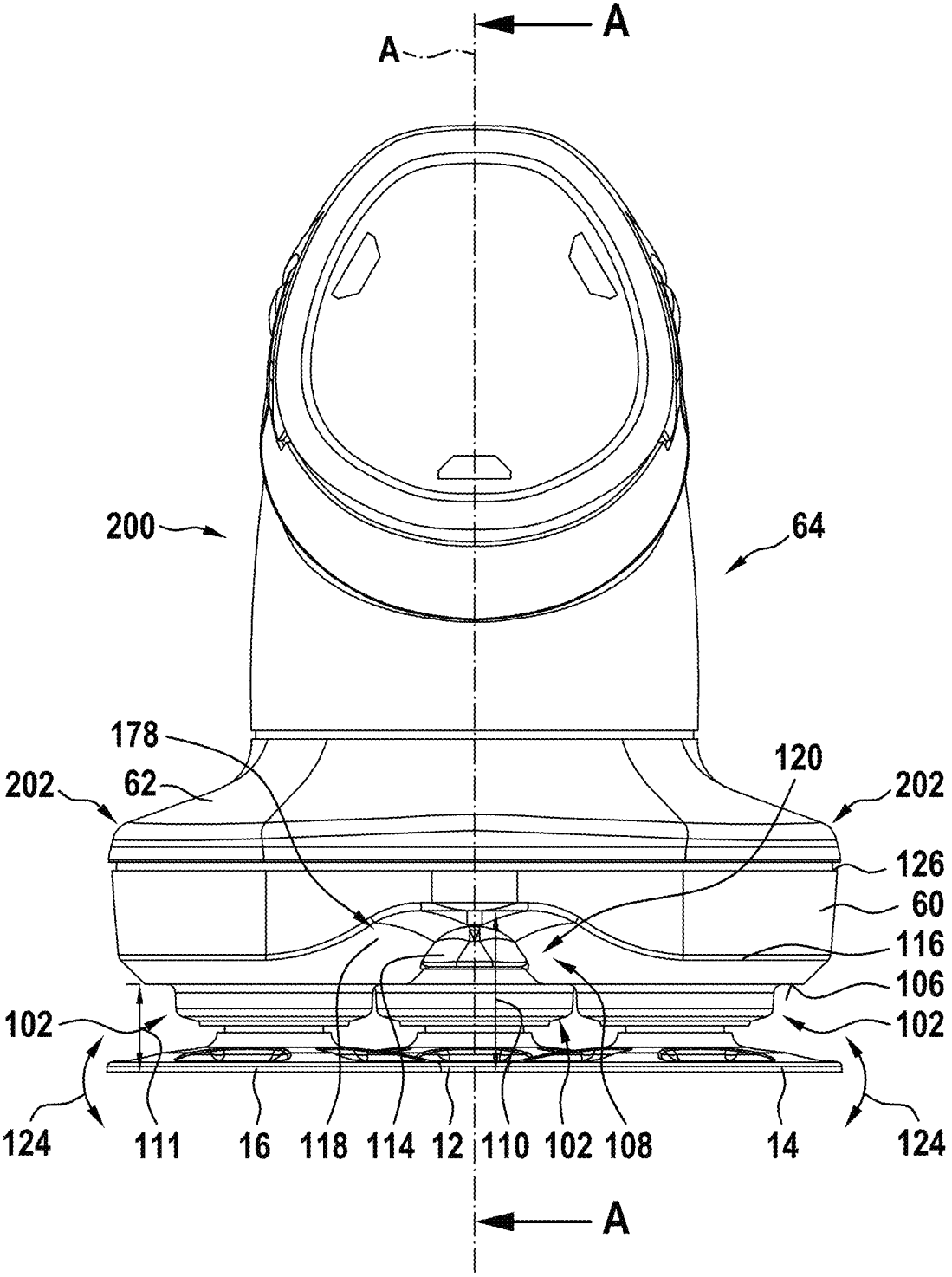
FIG. 6 shows the hand-held power tool in a rear view.

Analogously to the recess 108 between the grinding disks 12, 16 (front and rear grinding disks) or the associated grinding disk receiving regions 102, there is also provided between the rear grinding disks 14, 16 or the associated grinding disk receiving regions 102 a recess 108 (cf. FIG. 6). From FIG. 6, which shows this recess in rear view, can likewise be seen that the recess or the distance 110 from the center region 114 of the housing part 60 to the rim 116 of the housing part 60 or from the center increases in the radially outward direction. The rear recess 108 is structured in mirror symmetry to the plane A (compare also section A-A according to FIG. 2).

Moreover, the recess 108 enables a contact-free tilting 124 of the grinding disks 12, 14, 16 relative to the housing part 60. Thus, during operation of the grinder 10, for instance, a rim of the grinding disk 12, 14, 16 does not rub against the housing 60. The three recesses 108 between the grinding disks 12, 14, 16 or grinding disk holders 56 are arranged, starting from the center, respectively offset from one another by 120°. They are respectively mirror-symmetrical to the angle bisector of the regular triangle.

Moreover, FIGS. 5 and 6 show a housing separating edge 126. The housing separating edge 126 is disposed between the housing part 60 and the further housing part 62. Both housing parts 60, 62 are part of the output shaft housing 202 or of the main housing 64. The housing separating edge 126 constitutes, in particular, a housing separating joint 130. The housing separating edge 126 or the housing separating joint 130 is formed by assembled housing shells of the hand-held power tool or grinder 10. It forms a back-offset in the housing surface. It is running around the output shaft housing 202. It constitutes a form closure element 132, in particular a latching groove 134, for receiving a corresponding form closure element 136 of a dust extraction hood 138 (cf. FIG. 7), preferably of a latching extension 140 of a dust extraction hood 138. The form closure element 132 can in principle constitute, instead of a groove or recess, also a protuberance or male form closure element. Similarly, on the dust extraction hood 138 a female form closure element can be provided instead of a male. In addition, the recess 108 in the housing part 60 serves as a further form closure element 142, in particular as a stop element 144 for a further corresponding form closure element 146 on the dust extraction hood 138. When the dust extraction hood 138 is mounted, as intended, from the grinding disk plane 112 onto the output shaft housing 202, or is slipped over the housing part 60, the form closure element or elements 146 serves/serve as a stop or as a stopper. Thus, the dust extraction hood 138 is not pushed too far onto the output shaft housing 202. As soon as the form closure elements 146 touch, the form closure elements 138 also latch into their intended position or into the corresponding form closure element 132.

Figure 7:
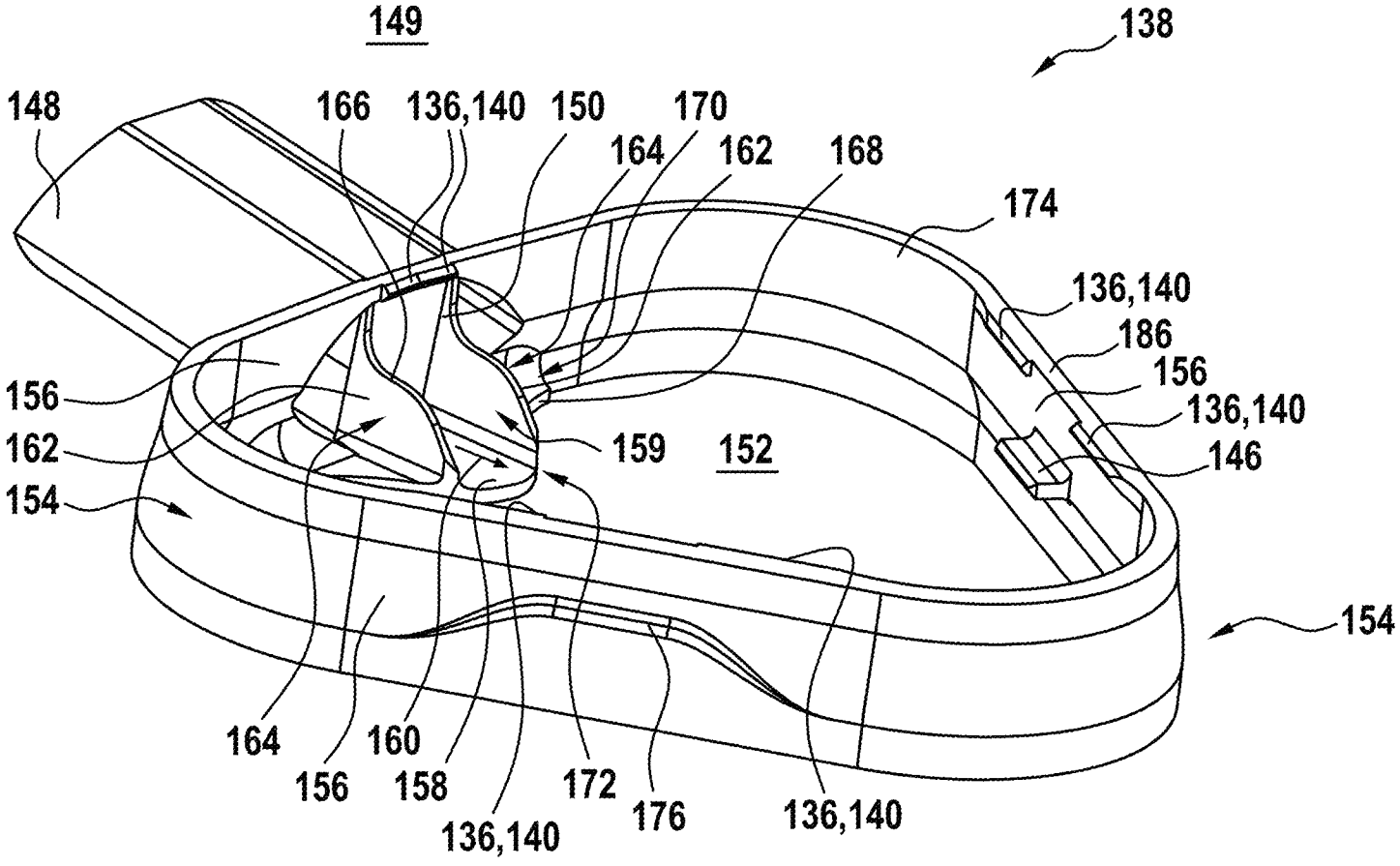
FIG. 7 shows the dust extraction hood in a perspective view.

FIG. 7 shows the dust extraction hood 138 in a perspective view. There is a removable dust extraction hood 138 for a hand-held power tool, in particular for the grinder 10, in particular wherein the hand-held power tool is configured to drive a plurality of grinding disks 12, 14 16, which, in particular, are tiltably mounted and can be driven in a rotating and/or oscillating and/or randomly oscillating manner. The dust extraction hood 138 has a connector 148 for connection to a dust extraction apparatus (not represented here)—typically a mobile or stationary vacuum cleaner or dust extraction apparatus. The connector 148 projects to outside 149 the dust extraction hood 138. The dust extraction hood 138 has an extraction opening 150, which leads off from the connector 148 and which is open toward the inside 152 of the dust extraction hood 138. The dust extraction hood 138 has a substantially triangular geometry, in particular a substantially regular triangular geometry. By "substantially" should here be understood that the corners 154 of the "triangle", as represented in FIG. 7, can be rounded. Moreover, the legs 156 can also conditionally deviate from a straight shape, for instance can be slightly arcuate or the like.

In the region of the extraction opening 150, the dust extraction hood 138 has an extension 158. This serves to avoid a transverse airflow, in particular from beneath 184 (cf. FIG. 8) the extension 158, thus beneath that side of the extension 158 that is facing away from the extraction opening 150. The extension 158 juts into the inside 152 of the dust extraction hood 138. Starting from the extraction opening 150, the extension 158 has a direction of principal extent 160 into the inside 152 of the dust extraction hood 138. In addition, the extension 158 has at least one, in particular two, walls 162. This/these serve(s) to reduce the transverse airflow, in particular to reduce the transverse airflow from beneath 184 the dust extraction hood 138 and/or from laterally 164 within the dust extraction hood 138. However, the extension 158 and/or the wall 162 can also, at least in part, be laterally open 166, 168, in particular to enable the transverse airflow in at least this region 170, 172. The extension 158 forms a part of an air guide channel 159. In particular, the part of the air guide channel 120 and the other part of the air guide channel 159 jointly form an air guide channel 120, 159.

The dust extraction hood 138, or the frame 174 of the dust extraction hood 138, is flexible, in particular transversely to the bottom side or top side of the dust extraction hood 138 or in the direction of the inside 152 or outside 149 of the dust extraction hood 138. This enables a resiliently elastic pre-tensioning and or a pressing of the dust extraction hood 138 against the hand-held power tool, in particular the grinder 10 or its housing. A toolless and/or secure and/or low-gap connection to the grinder 10 can thereby be created.

The frame 174 or the dust extraction hood 138 tapers from bottom to top. In the region of the form closure elements 136, for the connection to the form closure elements 142 of the hand-held power tool, the frame 174 or the dust extraction hood 138 is tapered. It is thereby ensured that an upper rim 186 of the frame 174 or of the dust extraction hood 138 can bear against the housing of the hand-held power tool, as far as possible in a gap-free manner. The pretensioning force of the dust extraction hood 138 in this region can thus act particularly efficiently.

Figure 8:
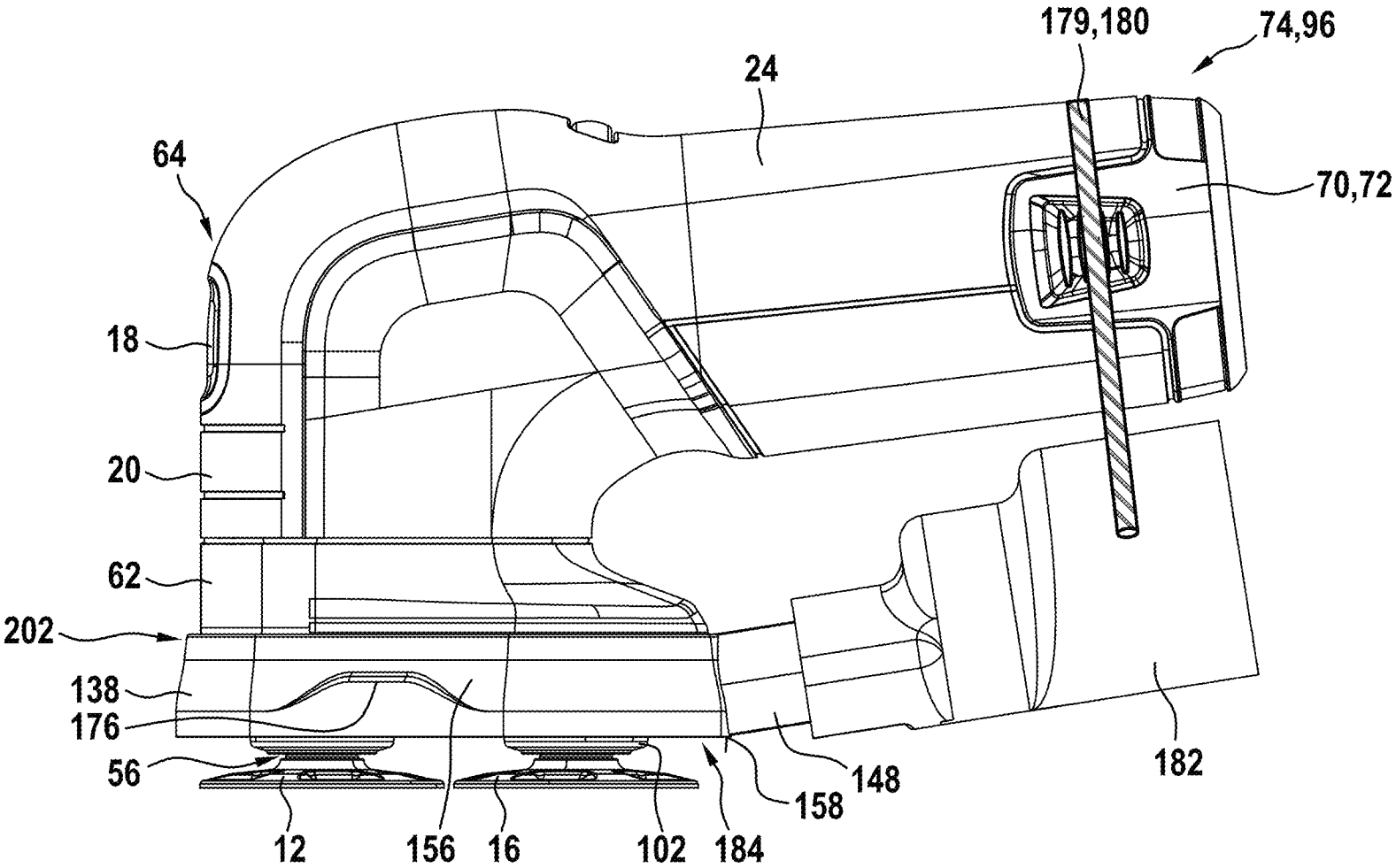
FIG. 8 shows the system comprising hand-held power tool and dust extraction hood in a side view.

In addition, the dust extraction hood 138 can be configured as a spacer and/or impact protection for the hand-held power tool or grinder (cf. also FIG. 8).

Instead of the housing of the grinder 10, the frame 174, or the rounded corners 154 and/or legs 156, serves as impact protection. The dust protection hood 138 also has a grip contour 176. The grip contour 176 constitutes a slight elevation on the leg 156 or on the frame 174. The friction between finger and dust extraction hood 138 when the dust extraction hood 138 is pushed onto or pulled off from the grinder 10 is thereby improved. Moreover, the grip contour 176 resembles the silhouette contour 178 at least of one region of the hand-held power tool or grinder (cf. FIGS. 5 and 6). The silhouette contour is here formed by the contour of the rim 116 of the housing part 60, in particular in the region of the recess 108, in particular when the rim 116 or the grinder 10 is viewed laterally.

FIG. 8 represents the system comprising hand-held power tool or grinder 10 with connected or mounted dust extraction hood 138. In addition to the component parts already described, the dust extraction hood 138 or the hand-held power tool or grinder 10 has an in particular elastic connecting element 179, in particular an elastic band 180, preferably an elastomeric band 180, for connecting the connector 148 or a connector adapter 182 and the grinder 10. The elastic band 180 is clamped, in particular between a free end 74, 96 of the handle 24 or storage battery 70, 72 of the grinder 10 and the connector 148 or connector adapter 182. Preferably, the elastic band is captively fastened to the connector 148, connector adapter 182, or the handle 24. Here, for instance, by bonding or injection molding to the connector adapter. Alternatively, the band can also be detachable on one side, so that, in the open state, it can be butted against or wrapped around the respectively other component part and can be re-fixed—for example with a snap fastener, a locking mechanism or the like.

FIG. 9, figures a-d, shows the hand-held power tool or grinder 10 of the previous figures in a hatched representation in order to also make curvatures visible. FIG. 9*a* shows the grinder 10 in a side view, FIG. 9*b* in a rear view, FIG. 9*c* in a perspective view, and FIG. 9*d* in a top view. The grinder 10 is for the simultaneous driving of three, in particular tiltable, grinding disks 12, 14, 16, which are driven in a rotating and/or oscillating and/or randomly circular manner and have at least an output shaft housing 202, which latter substantially encloses three output shafts 40 (not represented here, cf. in particular FIG. 2) orthogonally to the output shaft axes 42, 202, 204, 206, and a motor housing 200, which substantially encloses the motor 26 orthogonally to the motor shaft axis 30. The grinder 10 has a handle 24. The frontal output shaft axis 42, 204 can be better distinguished from the rear output shaft axes 42, 206, 208 by the additional reference symbols. The output shaft housing 202 encloses the three output shafts 40 at least substantially orthogonally to the output shaft axes 42. The motor housing 200 encloses the motor 26 at least substantially orthogonally to the output shaft axis 30.

A sectional area 210 of the motor housing 200 orthogonally to the motor shaft axis 30 in a constricted region 212 of the motor housing 200 amounts, relative to a sectional area 214 of the output shaft housing 202 orthogonally to the output shaft axes 42 in an extended region of the output shaft housing 202, in particular the most extended region 216 of the output shaft housing 202, to less than 70%, in particular less than 65%, preferably less than 55%. In the represented FIG. 10, it amounts to around 52%. The extended region 216 should be understood, in particular, as being the region having the largest sectional area 214 of the output shaft housing 202. Thus, in this region 216, an extent, for example the length 218 or the peripheral distance or length 215 around the output shaft housing 202, is maximal. In addition, in the side view, rear view and top view of FIGS. 9*a-c*, also a length and width of the motor housing 200 in the restricted region 212, and of the output shaft housing 202 in the extended region 216, is provided with the following reference symbols: output shaft housing 202: length 218, width 220; motor housing: length 222, width 224. Proportionally, the extended region 216 of the output shaft housing 202 in relation to the constricted region 212 of the motor housing 200 is around 30% longer and around 65% wider. Also the sectional area relationship of the extended region 216 of the output shaft housing 202 in relation to the constricted region 212 of the motor housing 200 amounts to around 190% (cf. FIG. 10).

Figure 10:
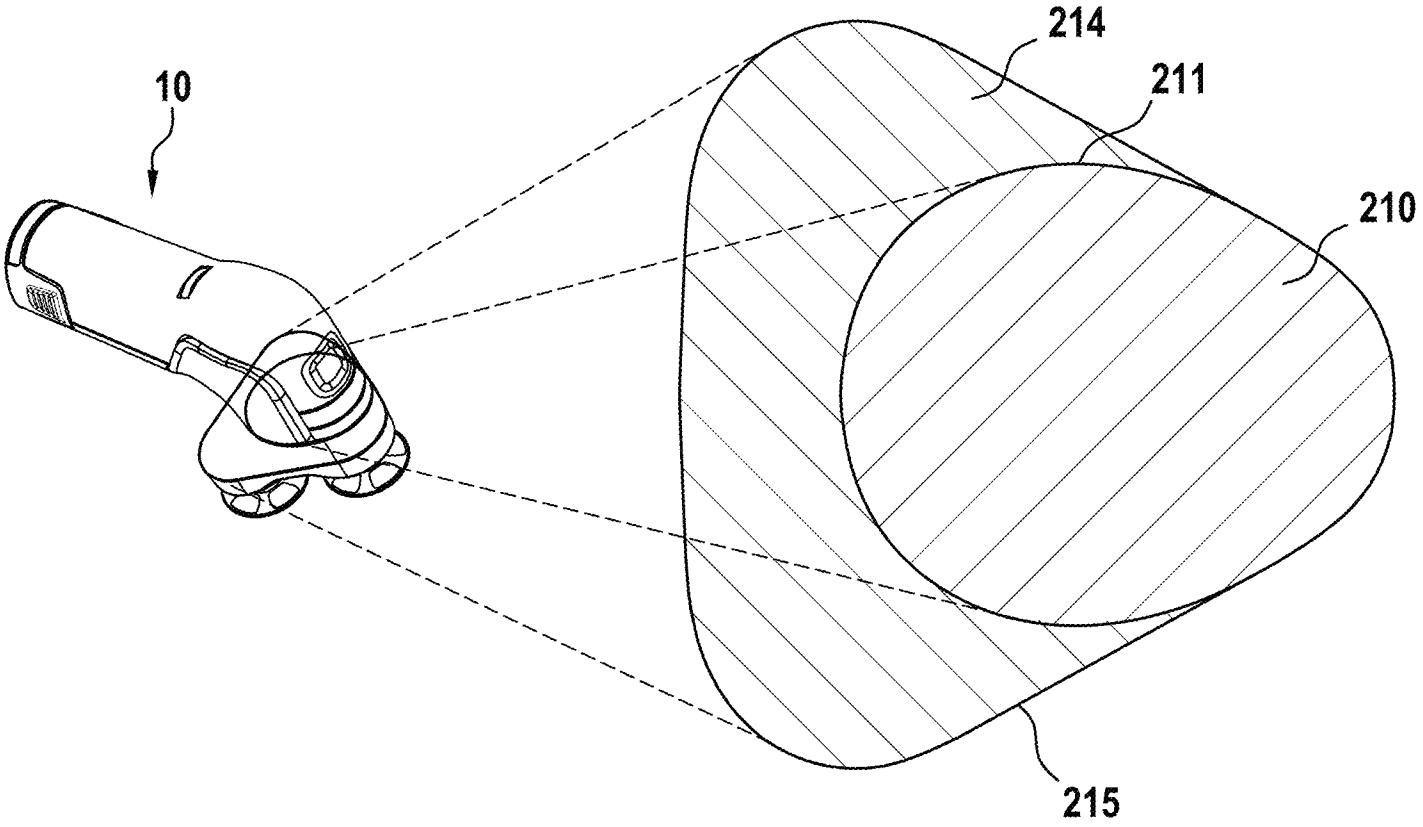
FIG. 10 shows the sectional area or the sectional area relationship of a constricted and an extended region of the hand-held power tool.

From FIG. 10, the sectional area relationship of certain regions is also evident. The sectional area 214 of the output shaft housing 202 in a rear region 226 of the hand-held power tool or grinder 10 is covered in the measure of less than 75%, in particular in the measure of less than 50%, preferably in the measure of less than 25%, by that sectional area 210 of the motor housing 200 that is projected along the motor shaft axis 30, in particular in the constricted region 212. Analogously, the grinding area 232 of grinding discs 14, 16 applied to the rear of the grinder 10 is covered in the measure of less than 75%, in particular in the measure of less than 50%, preferably in the measure of less than 25%, by that sectional area 210 of the motor housing 200 that is projected along the motor shaft axis 30, in particular in the constricted region 212. In a frontal region 228 of the hand-held power tool, that sectional area 210 of the motor housing 200 that is projected along the motor shaft axis 30, in particular also in the constricted region 212, covers the sectional area 214 of the output shaft housing 202 in the measure of more than 70%, in particular in the measure of more than 90%, preferably fully. Analogously, the grinding area 234 of a grinding disc 12 applied frontally to the grinder 10 is covered in the measure of more than 70%, in particular in the measure of more than 90%, preferably fully, by that sectional area 210 of the motor housing 200 that is projected along the motor shaft axis 30, in particular also in the constricted region 212.

In addition, from FIG. 10, a peripheral length 211 of the motor housing 200 orthogonally to the motor shaft axis 30 or the output shaft axes 42 in an, in particular constricted, region 212 of the motor chousing 200 relative to a peripheral length 215 of the output shaft housing 202 orthogonally to the output shaft axes 42, 204, 206, 208 in an, in particular extended, region 216 of the output shaft housing 202 is also evident. It amounts to less than 80%, here roughly 70%. In other words, the peripheral length 215 of the output shaft housing 202 in relation to the peripheral length 211 of the motor housing 200 in the constricted region 212 amounts to around 145%.

Furthermore, one, in particular two, of the three output shaft axes 42, in particular the rear two output shaft axes 206, 208 of the hand-held power tool, lie outside the motor housing 200, in particular outside the constricted region 212 of the motor housing 200. These output shaft axes 206, 208 thus do not intersect the motor housing 200, at least not in the constricted region 212, in particular nowhere. In addition, one, preferably two, of the three output shaft axes 204, 206, 208, in particular the rear two output shaft axes 206, 208 of the hand-held power tool or grinder 10, lie outside the handle 24, in particular the barrel-shaped handle 24. They lie also outside a dented region 230 or a concave indentation of the handle 24 and/or motor housing 200, or a dented transition region 276 of handle 24 and motor housing 200. The frontal output shaft axis 204 of the hand-held power tool or grinder 10 lies within the motor housing 200 and/or within a motor housing handle 236 and thus intersects the latter.

Figure 9A:
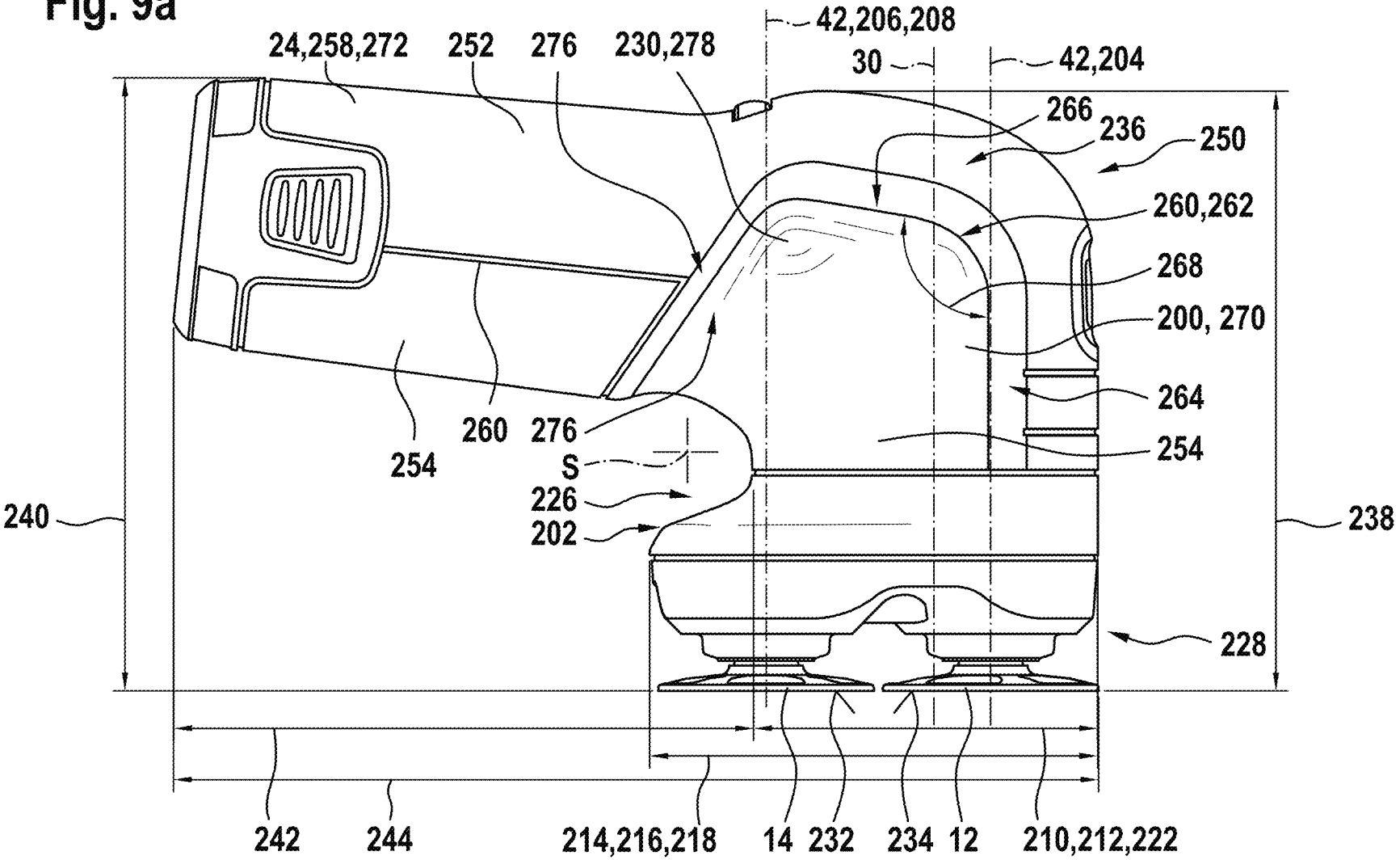
FIG. 9*a-d* show the hand-held power tool in a hatched representation in four views.
Figure 9B:
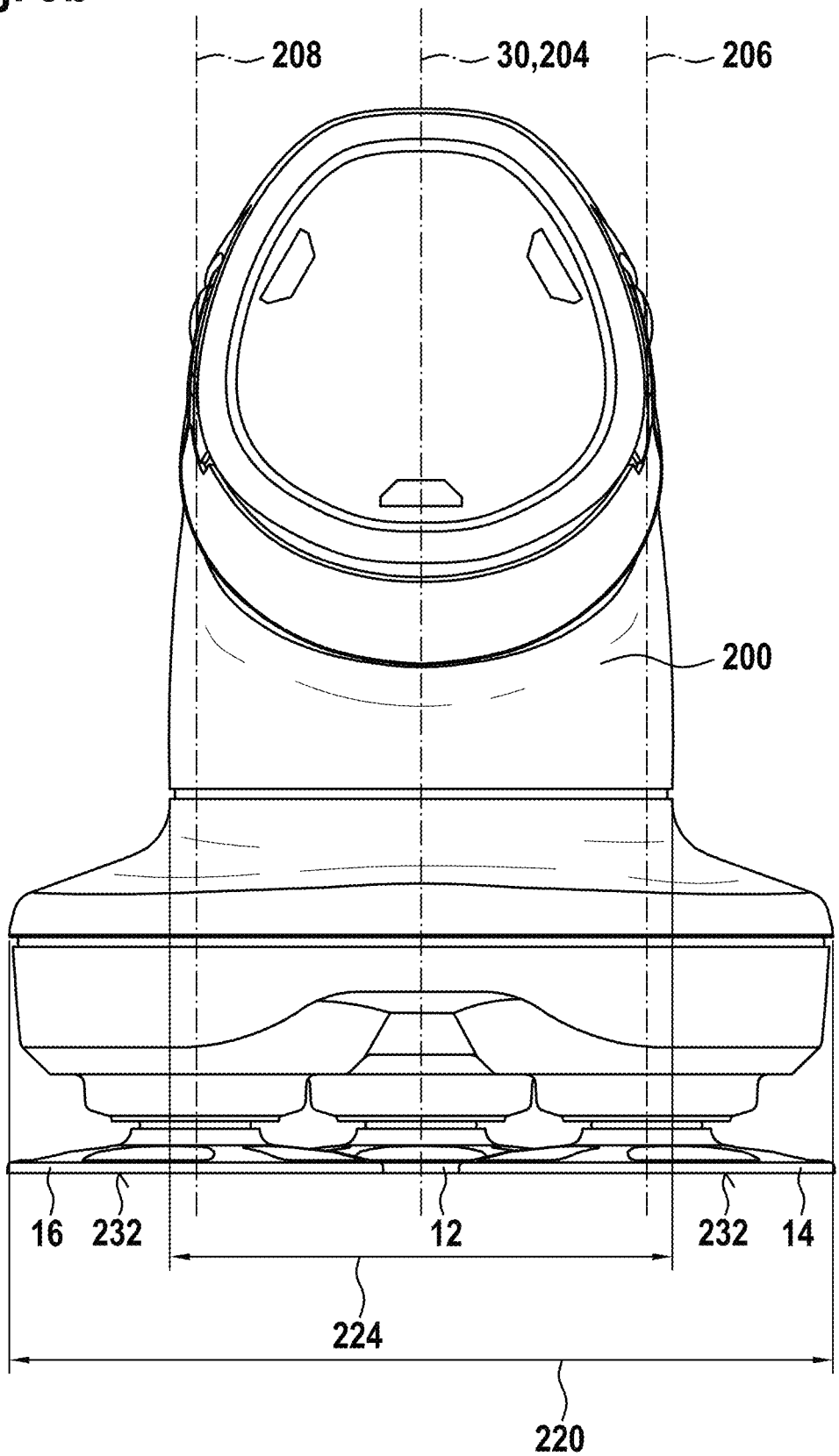
Figure 9C:
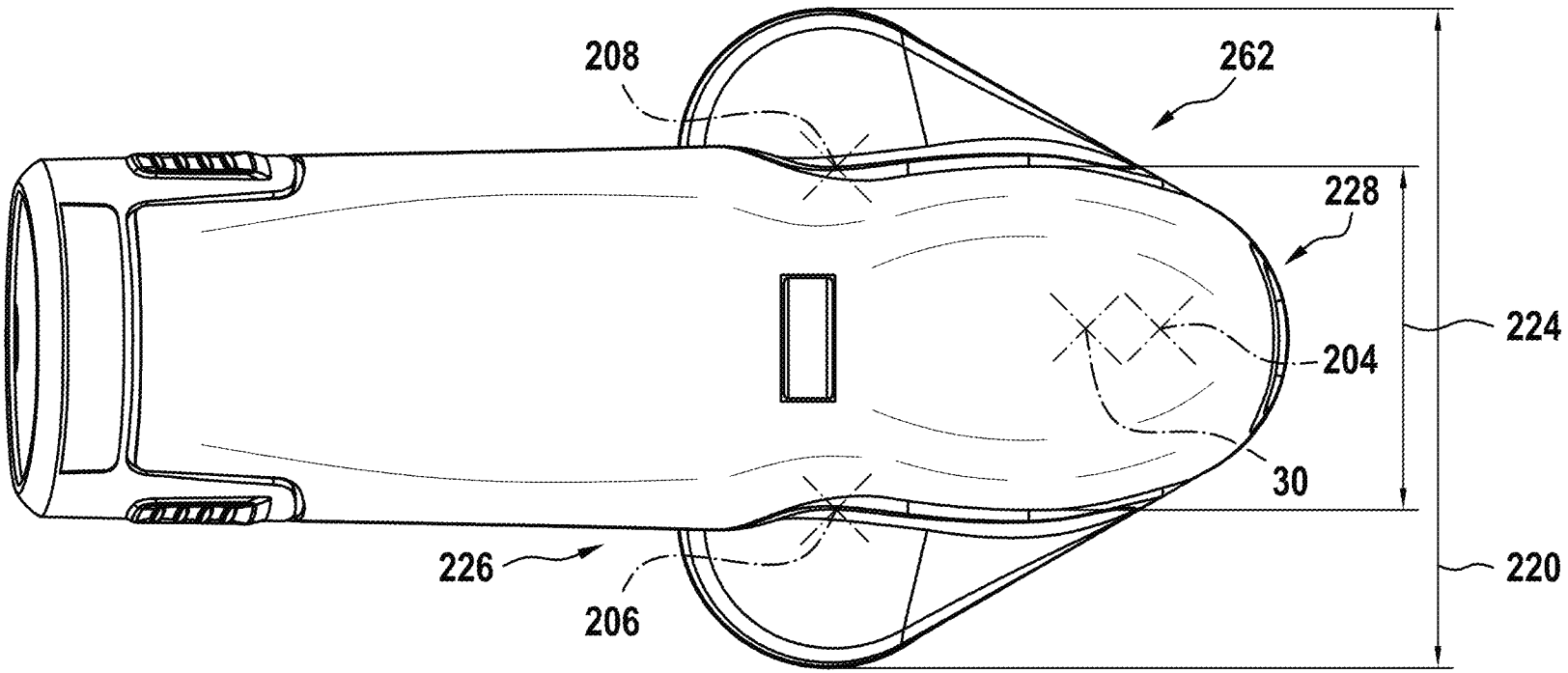
Figure 9D:
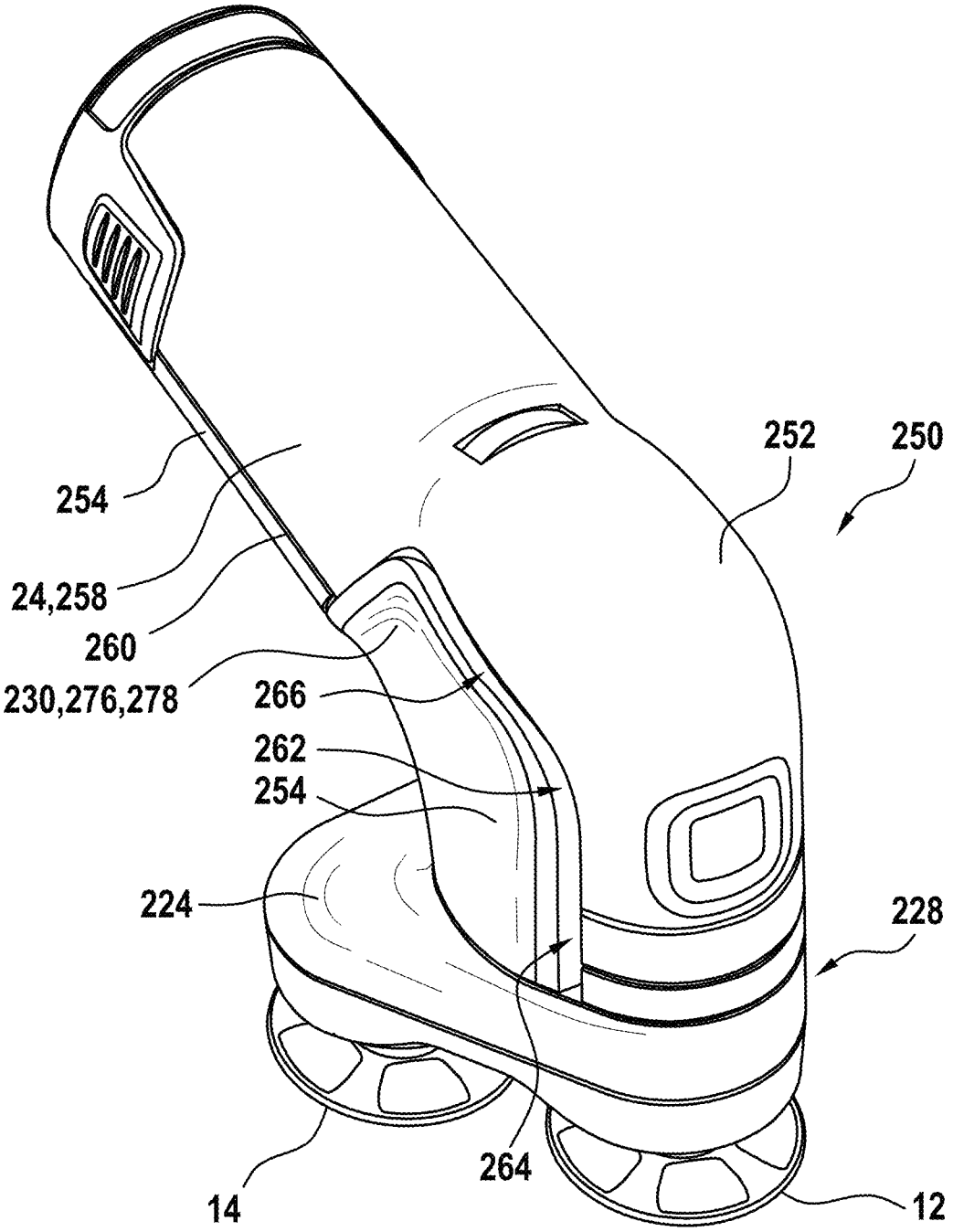

From the side view according to FIG. 9*a*, it is further evident that the relationship of the height 238, 240 of the hand-held power tool in the direction of the output shaft axes 42, 204, 206, 208, in particular a height 238 of a motor housing and output shaft housing 200, 202, to the length 242 of a substantially barrel-shaped handle 24, in particular a length 242 of a barrel-shaped handle 24 protruding substantially orthogonally to the motor housing 200 or to the drive and output shaft axis 30, 204, varies by less than 50%, in particular by less than 75%, preferably by less than 85%, in particular is roughly identical. A barrel-shaped handle protruding substantially orthogonally to the drive or output shaft axis or axes 30, 204 should here be understood in an angular range of 60°-120°, in particular of 75°-105°, preferably 90°, in relation to the drive and output shaft axis/axes 30, 204, 206, 208. Advantageously, a very compact hand-held power tool can thereby be provided. The center of gravity S thus moves as close as possible to the grinding disks 12, 14, 16. In addition, a relationship of a total length 244 of the hand-held power tool orthogonally to at least one drive or output shaft axis 30, 42, 204, 206, 208, in particular from one end of the motor housing 200 up to an end of the handle 24, which latter protrudes in the shape of barrel, relative to a height 238, 240 of the hand-held power tool along at least one direction of the drive or output shaft axis 30, 42, 204, 206, 208, in particular from a grinding disk plane 112 up to the end of the handle 24 or motor housing 200, is greater than 10%, in particular is greater than 25%, is preferably around 40% greater.

Furthermore, the weight of the storage battery 72 relative to the components of the drive train, in particular comprising the motor 26, the pinion 32, the central wheel 34, the output shaft 40 and spur wheels 44, amounts to around 10-50% more, in particular 30-40% more.

The position of the center of gravity S can thereby be positively influenced. A volume of motor and output shaft housing 200, 202 in relation to the barrel-shaped handle housing 68 amounts to around 20-70% more, in particular around 50% more.

Figure 11:
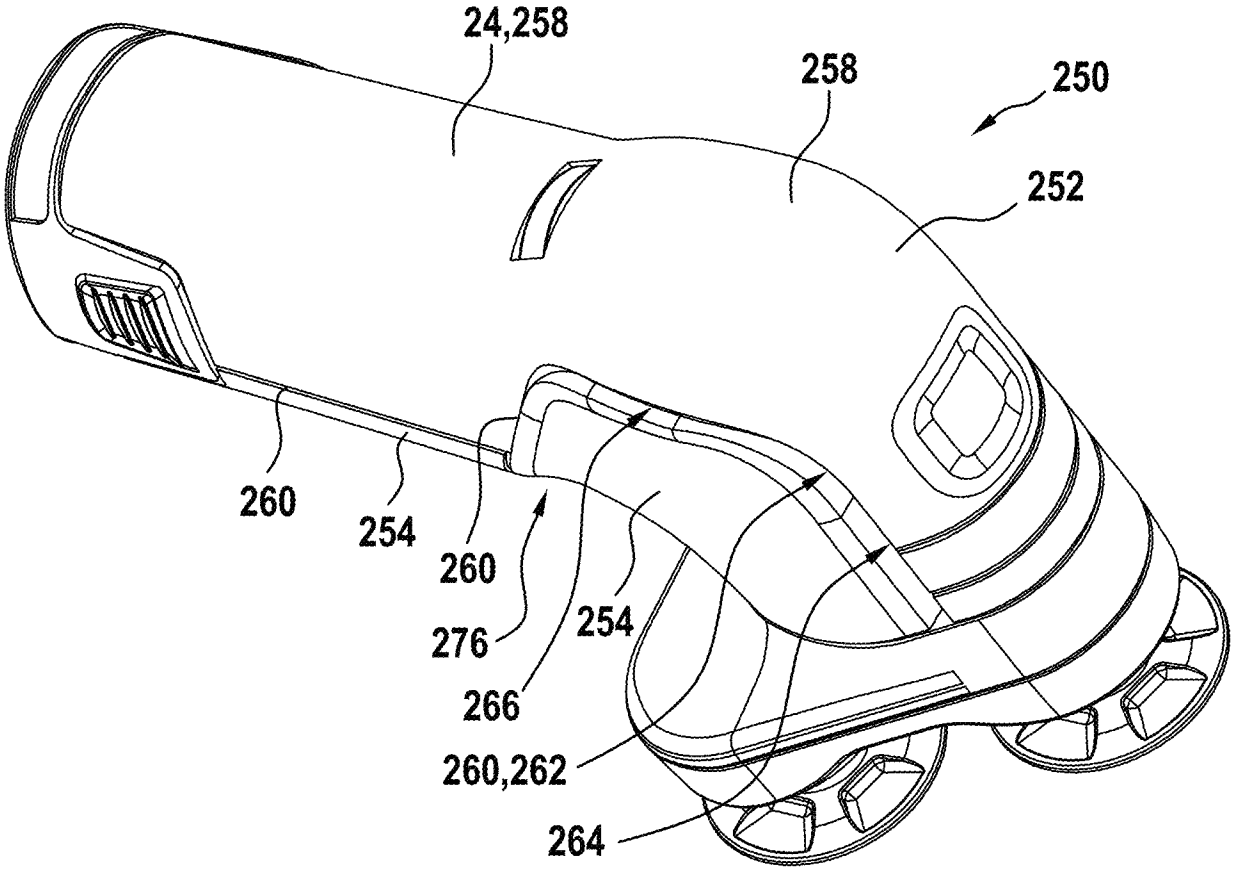
FIG. 11 shows the hand-held power tool in a perspective representation.

From the side view and the perspective view according to FIG. 9*a, d*, as well as from FIG. 11, a grinding machine housing 250, having at least a housing shell element 252 and having at least a further housing shell element 254 connected to the housing shell element 252, which, at least in some sections, forms a handle 24, 258, is also evident. The grinding machine housing 250 is characterized by at least one vent opening 262, in particular a ventilation slot, formed, at least in some sections, in the region of a separating edge 260 of the housing shell element 252 and of the further housing shell element 254. The vent opening 262 advantageously extends over two regions 264, 266, which are arranged at an angle 268, in particular an angle 268 (cf. FIG. 10, side view) between 90° and 120°, preferably between 90° and 120°, preferably between 100° and 105°, one to another. Advantageously, the angle is based on the orientation of the barrel-shaped handle to the motor housing. The vent opening regions are advantageously oriented parallel to their principal extent.

Advantageously, the vent opening 262, in particular that of the portion 266 in the region of the handle 258, is provided to flow around, in particular, to cool, to warm and/or to dry, the hand of a user.

The housing shell element 252 and the further housing shell element 254 are connected to one another, in particular fixed to one another, in particular along an at least substantially whole contact line and/or contact surface of the housing shell element 252 and of the further housing shell element 254, such that these are at least substantially free from visible fastening elements. In addition, the handle 24, 258, at least on a side of the handle 24, 258 that is facing toward and/or facing away from a grinding disk 12, 14, 16 or tool side, is configured such that it is at least substantially free of separating edges.

In addition, the grinding machine housing 250 has a motor housing portion 270 and a barrel-shaped handle housing portion 272, wherein the grinding machine housing 250, in a transition region 276 between the barrel-shaped handle housing portion 272 and the motor housing portion 270, has a concave indentation 278 or a dent (cf. FIG. 10). This serves as an ergonomic bearing surface for a finger, in particular a thumb, of the user. The dent is clearly discernible, in particular in the side view of FIG. 9*a*. The hatching indicates the curved region, Preferably, the vent opening(s) 262 can be formed by an offset of a housing edge of the housing shell element 252 and of the further housing shell element 254.

The invention claimed is:

1. A hand-held power tool for simultaneously driving a plurality of grinding disks, comprising:

a motor having a drive shaft that defines a motor axis;

a main housing that accommodates at least the motor;

a handle housing forming a handle that protrudes substantially transversely to the main housing;

a central wheel driven by the motor and which defines a central wheel axis; and a plurality of output shafts driven by the central wheel, each output shaft of the plurality of output shafts defining a respective output shaft axis and being configured to drive a respective grinding disk or a respective grinding disk holder, the plurality of output shafts including a frontal output shaft having a frontal output shaft axis, the frontal output shaft arranged further from the handle than other output shafts of the plurality of output shafts, wherein the motor axis is arranged eccentrically to the central wheel axis, and wherein the motor axis and at least part of the motor are arranged between the frontal output shaft axis and the central wheel axis.

2. The hand-held power tool as claimed in claim 1, wherein the motor or the motor axis is disposed on an opposite side of the central wheel axis from the handle.

3. The hand-held power tool as claimed in claim 1, wherein the handle is a cylindrical handle.

4. The hand-held power tool as claimed in claim 1, further comprising:

a storage battery arranged in the handle or the handle housing.

5. The hand-held power tool as claimed in claim 4, wherein the storage battery is an exchangeable insertable storage battery.

6. The hand-held power tool as claimed in claim 1, wherein:

the main housing further accommodates the central wheel, the drive shaft, and the plurality of output shafts, and the handle protrudes from the main housing at an angle of from 45° to 135° in relation to an orientation of the central wheel axis.

7. The hand-held power tool as claimed in claim 6, wherein the angle is from 85° to 105°.

8. The hand-held power tool as claimed in claim 1, wherein:

the handle has a longitudinal central axis, the longitudinal central axis and the central wheel axis defines a first plane, and two output shafts of the plurality of output shafts are arranged in mirror symmetry to the first plane.

9. The hand-held power tool as claimed in claim 8, wherein the frontal output shaft lies in the first plane.

10. The hand-held power tool as claimed in claim 9, wherein the motor axis lies in the first plane.

11. The hand-held power tool as claimed in claim 8, wherein the first plane centrally intersects a storage battery and/or the motor.

12. The hand-held power tool as claimed in claim 8, further comprising:

the plurality of grinding disks, wherein a center of gravity of the hand-held power tool is located on an opposite side of the central wheel axis from the motor axis and is at a distance from the central wheel axis equating to a radius of one of the plurality of grinding disks, and wherein the center of gravity is located in the first plane in a region defined extending from a free end of the handle to a second plane, which is defined by the respective output shaft axes of the two output shafts that are arranged in mirror symmetry to the plane.

13. The hand-held power tool as claimed in claim 1, further comprising:

the plurality of grinding disks, wherein the hand-held power tool is configured to rest on three points, first and second points of which are defined by two grinding disks of the plurality of grinding disks that are arranged closer to the handle, and a third point of the three points is defined by a free end of the handle or of an insertable storage battery accommodated in the handle.

14. The hand-held power tool as claimed in claim 1, wherein the hand-held power tool is a grinder configured to drive the plurality of grinding disks in a rotating and/or oscillating and/or randomly circular manner.

15. The hand-held power tool as claimed in claim 1, wherein the plurality of output shafts includes three output shafts.

16. A hand-held power tool, comprising:

a motor having a drive shaft that defines a motor axis;

a central wheel driven by the motor and which defines a central wheel axis; and a plurality of output shafts driven by the central wheel, each output shaft of the plurality of output shafts defining a respective output shaft axis and being configured to a plurality of grinding disks driven simultaneously by the plurality of output shafts, wherein the motor axis is arranged eccentrically to the central wheel axis, and wherein a center of gravity of the hand-held power tool is located on an opposite side of the central wheel axis from the motor axis and is at a distance from the central wheel axis equating to a radius of one of the plurality of grinding disks.

17. A hand-held power tool for simultaneously driving a plurality of grinding disks, comprising:

a motor configured to drive the grinding disks;

a main housing, which accommodates at least the motor; and a handle housing, which forms a handle and protrudes from a rear side of the main housing in a direction substantially transversely to the main housing;

a central wheel driven by the motor and which defines a central wheel axis; and three output shafts driven by the central wheel, each output shaft of the three output shafts defining a respective output shaft axis and being configured to drive a respective grinding disk or a respective grinding disk holder, the three output shafts including a forward output shaft and two rear output shafts, wherein the motor has a drive shaft that defines a motor axis, wherein the motor axis is arranged eccentrically to the central wheel axis, and wherein the drive shaft is arranged between the central wheel axis and the respective output shaft axis of the forward output shaft.

18. The hand-held power tool as claimed in claim 17, further comprising:

an insertable storage battery removably arranged in the handle housing.

19. The hand-held power tool as claimed in claim 18, wherein:

the hand-held power tool is a grinder configured to drive the plurality of grinding disks in a rotating and/or oscillating and/or randomly circular manner, and the plurality of output shafts includes three output shafts, the handle housing protrudes as a cylindrical handle from the main housing.

* * * * *